US011493186B2

(12) United States Patent
Belliveau et al.

(10) Patent No.: US 11,493,186 B2
(45) Date of Patent: Nov. 8, 2022

(54) THEATRICAL STROBE APPARATUS AND LIGHT SOURCES WITH OPTIMIZED FOCUS THEREOF

(71) Applicants: Richard S. Belliveau, Austin, TX (US); Ryan Waters, San Antonio, TX (US)

(72) Inventors: Richard S. Belliveau, Austin, TX (US); Ryan Waters, San Antonio, TX (US)

( * ) Notice: Subject to any disclaimer, the term of this patent is extended or adjusted under 35 U.S.C. 154(b) by 128 days.

(21) Appl. No.: 17/325,259

(22) Filed: May 20, 2021

(65) Prior Publication Data

US 2022/0178516 A1 Jun. 9, 2022

Related U.S. Application Data

(63) Continuation-in-part of application No. 17/114,587, filed on Dec. 8, 2020, now abandoned.

(51) Int. Cl.

| | |
|---|---|
| ***F21V 14/04*** | (2006.01) |
| ***F21V 7/04*** | (2006.01) |
| ***F21V 29/70*** | (2015.01) |
| ***F21Y 115/10*** | (2016.01) |
| ***F21W 131/406*** | (2006.01) |

(52) U.S. Cl.

CPC ..... *F21V 14/04* (2013.01); *F21V 7/04* (2013.01); *F21V 29/70* (2015.01); *F21W 2131/406* (2013.01); *F21Y 2115/10* (2016.08)

(58) Field of Classification Search

CPC . F21V 14/04; F21V 29/70; F21V 7/04; F21Y 2115/10; F21W 2131/406

See application file for complete search history.

(56) References Cited

U.S. PATENT DOCUMENTS

| | | | | |
|---|---|---|---|---|
| 3,628,852 A | | 12/1971 | Snaper | |
| 4,087,682 A | * | 5/1978 | Kolodziej | F21S 41/321 362/297 |
| 4,855,884 A | | 8/1989 | Richardson | |
| 4,872,098 A | * | 10/1989 | Romano | F21V 17/02 362/283 |

(Continued)

OTHER PUBLICATIONS

ASAP Technical Publication, BROPN1150 (Mar. 24, 2008), Segmented Reflector Design Automotive reflector design process with ASAP and Reflector CAD.

(Continued)

*Primary Examiner* — Tsion Tumebo

(74) *Attorney, Agent, or Firm* — Walter J. Tencza, Jr.

(57) ABSTRACT

A theatrical lighting apparatus including a plurality of light sources including a first light source and a second light source; and a plurality of reflector segments including first and second reflector segments; wherein the plurality of light sources are centrally located between the plurality of reflector segments; wherein each of the plurality of reflector segments has a focal point; wherein the first light source is located approximately the focal point of the first reflector segment; and wherein the second light source is located approximately the focal point of the second reflector segment. The plurality of light sources may include at least one white light emitting diode light source. The plurality of light sources may be fixed to a single heat exchanger centrally located between the plurality of reflector segments. The heat exchanger may be configured to be moved relative to the plurality of reflector segments by an actuator.

24 Claims, 11 Drawing Sheets

(56) References Cited

U.S. PATENT DOCUMENTS

| | | | | |
|---|---|---|---|---|
| 5,276,601 | A * | 1/1994 | Holzhacker | F21V 1/00 362/290 |
| 5,816,691 | A * | 10/1998 | Gordin | F21S 8/088 362/283 |
| 6,607,289 | B2 * | 8/2003 | Lassovsky | F21V 7/24 362/283 |
| 7,452,111 | B2 | 11/2008 | Mazzei | |
| 7,771,086 | B2 | 8/2010 | Goverde | |
| 8,845,136 | B2 | 9/2014 | Savage, Jr. | |
| 10,694,600 | B1 | 6/2020 | Edwards | |
| 2002/0159262 | A1 * | 10/2002 | Romano | F21V 7/28 362/345 |
| 2003/0227774 | A1 | 12/2003 | Martin | |
| 2005/0265024 | A1 | 12/2005 | Luk | |
| 2010/0014291 | A1 | 1/2010 | Ben Natan | |
| 2014/0185288 | A1 | 7/2014 | Cunningham | |
| 2014/0369039 | A1 * | 12/2014 | Den Boer | F21V 29/505 362/235 |
| 2015/0285460 | A1 | 10/2015 | Langhart | |
| 2019/0320514 | A1 | 10/2019 | Edwards | |

OTHER PUBLICATIONS https://anomet.com/reflectors; Lighting Componenets; printed May 3, 2021.

* cited by examiner

THEATRICAL STROBE APPARATUS AND LIGHT SOURCES WITH OPTIMIZED FOCUS THEREOF

CROSS REFERENCE TO RELATED APPLICATION(S)

The present application is a continuation in part of and claims the priority of U.S. patent application Ser. No. 17/114,587 titled "THEATRICAL STROBE APPARATUS AND LIGHT SOURCES WITH OPTIMIZED FOCUS THEREOF", filed on Dec. 8, 2020.

FIELD OF THE INVENTION

This invention relates to theatrical lighting fixtures.

BACKGROUND OF THE INVENTION

Multi parameter theatrical lighting fixtures are generally known in the art.

U.S. Published Patent application no. US 2003/0227774 to Martin provides a segmented reflector 212 which includes a plurality of reflector segments. (Martin, paragraph 46). In Martin, each reflector segment " . . . is a region that is optimized for an emitting area on a post facet (e.g., one or more LED sources on the post face) . . . . Each reflective segment can be a smooth simple surface, a smooth complex surface, or divided into a number of sub-segments called facets." (Martin, paragraph 46).

However, Martin does not disclose that one reflector segment is physically separate from another reflector segment. Rather, a single physically integrated reflector, such as reflector 312 is provided, which has segments located thereon, such as segments 314-1 and 314-3. (Martin paragraph 57, FIG. 3B)

Thus each of Martin reflective segments of a single integrated segmented reflector, such as segmented reflector 312 or 212, are not physically moveable with respect to other reflective segments of the same single integrated segmented reflector. In fact, Martin expressly states: "Accordingly, the light pattern of the lamp is changed without physical mechanism". (Martin, paragraph 13).

Martin is directed to a physically integrated segmented reflector, i.e. where the segments cannot physically move with respect to each other, particularly as used for automobiles, and particularly as used for headlamps. For example, Martin states: " . . . in automotive applications, it is critical to design headlamps that do not generate glares into oncoming traffic." (Martin, paragraph 5, second sentence). Martin refers to "automotive" application (Martin, paragraph 42), and use of the single physically integrated segmented reflector for "conventional automotive headlamp" (Martin, paragraph 58, last two sentences) or "conventional headlamp" (paragraph 59, fourth sentence; paragraph 60; second sentence; paragraph 60, third sentence; paragraph 60, second to last sentence).

One skilled in the art would recognize that Martin uses the term "segmented reflector" in the sense of a physically integrated segmented reflector (where the segments do not physically move with respect to each other), as shown for example in "Segmented Reflector Design—Automotive reflector design process with ASAP and ReflectorCAD", ASAP Technical Publication, Mar. 24, 2008, https://www-.breault.com/sites/default/files/bropn1150_reflector.pdf. That article refers to "automotive segmented reflector design process", and shows an individual reflector segment which is physical integrated with the overall segmented reflector, such that the individual reflector segment does not move with respect to other reflector segments of the same overall segmented reflector.

U.S. Published Patent Application no. US 2019/0320514 to Edwards provides a lighting tower 138 including multiple LED light source extending in a direction indicated by numeral 139. (Edwards, paragraph 51). Edwards does not disclose physically moving the lighting tower 138. Rather: "The lighting tower 138 is fixed relative to the chassis 132 and the PAR 134. In traditional lighting systems using a parabolic optic, to adjust a beam angle, a bulb disposed in the parabolic optic is moved 2-3 inches relative to the parabolic optic using a mechanical actuator. For the lighting assembly 130, instead of moving the light source, the activated LEDs (e.g., the activated lighting elements of the illustrated embodiment) change, altering the location of the source of the light digitally by simply selecting different LEDs of the lighting tower 138 to illuminate. By lighting more LEDs in different locations, the lighting assembly 130 has more flexibility to change the beam shape." (Edwards, paragraph 51, first four sentences).

U.S. Pat. No. 8,845,136 to Savage et al. provides a reflector 120 which may comprise a single continuous sheet of reflective material or multiple sheets of reflective material, wherein a piece of reflective material may be attached to a movable structure. (Savage et al., col. 5, Ins. 11-20).

Savage et al. states: "In this way, the movable part of the support structure 130 may move independently of the stationary part of the support structure 130 and/or independently of another movable portion of the support structure 130. This independent movement enables a variety of configurations of the reflector 120." (Savage et al., col. 4, Ins. 46-51; FIG. 3a). Savage et al. refers to a central stationary skeletal structure 135 to which a strobe 22 is fixed by a strobe support 110, and to outer movable structures 170 and 175. (Savage et al., col. 3, In. 52-col. 4, In. 2; FIG. 3a). Savage et al. provides movement of the structures 170 and 175, and related reflector portions, up and down, parallel to the predominant direction of reflected light, due to the strobe 22, from the reflector portion fixed to central stationary skeletal structure 135. (Id.)

SUMMARY OF THE INVENTION

A lighting fixture primarily used for theatrical effect including the ability to change color, control beam angle, pan and tilt, and vary the light output from a dim glow to full power continuously.

The fixture, in at least one embodiment, may include a main overall reflector that has four segments with each segment paired to an independently controllable light source. Each light source may include multiple light emitting diode emitters typically including Red, Green, Blue, and White devices. The light sources may be other colors such as warm white, cool white, lime, amber, yellow, violet, cyan, and ultraviolet.

In at least one embodiment, a theatrical lighting apparatus is provided comprising a plurality of light sources including a first light source and a second light source; and a plurality of reflector segments including a first reflector segment and a second reflector segment; wherein the plurality of light sources are centrally located between the plurality of reflector segments; wherein each of the plurality of reflector segments has a focal point; wherein the first light source is located approximately the focal point of the first reflector segment; and wherein the second light source is located approximately the focal point of the second reflector segment.

The plurality of light sources may be comprised of at least one white light emitting diode light source.

The plurality of light sources may be fixed to a single heat exchanger centrally located between the plurality of reflector segments.

The heat exchanger may be configured to be moved relative to the plurality of reflector segments by an actuator.

The heat exchanger may be comprised of a liquid cooling system.

The plurality of reflector segments may include one or more further reflector segments in addition to the first reflector segment and the second reflector segment; and at least two of the plurality of reflector segments may be individually moveable by an actuator in relation to the other reflector segments of the plurality of reflector segments by an actuator.

The theatrical lighting apparatus may be further comprised of a positioning system to direct the light emitted from the plurality of light sources directed by the plurality of reflector segments.

The present invention, in at least one embodiment also provides a method comprising: providing a plurality of light sources including a first light source and a second light source; and providing a plurality of reflector segments including a first reflector segment and a second reflector segment; wherein the plurality of light sources are centrally located between the plurality of reflector segments; wherein each of the plurality of reflector segments has a focal point; wherein the first light source is located approximately the focal point of the first reflector segment; and wherein the second light source is located approximately the focal point of the second reflector segment.

The plurality of light sources may be comprised of one or more light sources as previously described and may be configured as previously described. The heat exchanger and the plurality of reflector segments may be configured as previously described.

The method may further include directing the light emitted from the plurality of light sources by use of the plurality of reflector segments through a positioning system.

DETAILED DESCRIPTION OF THE DRAWINGS

Figure 1:
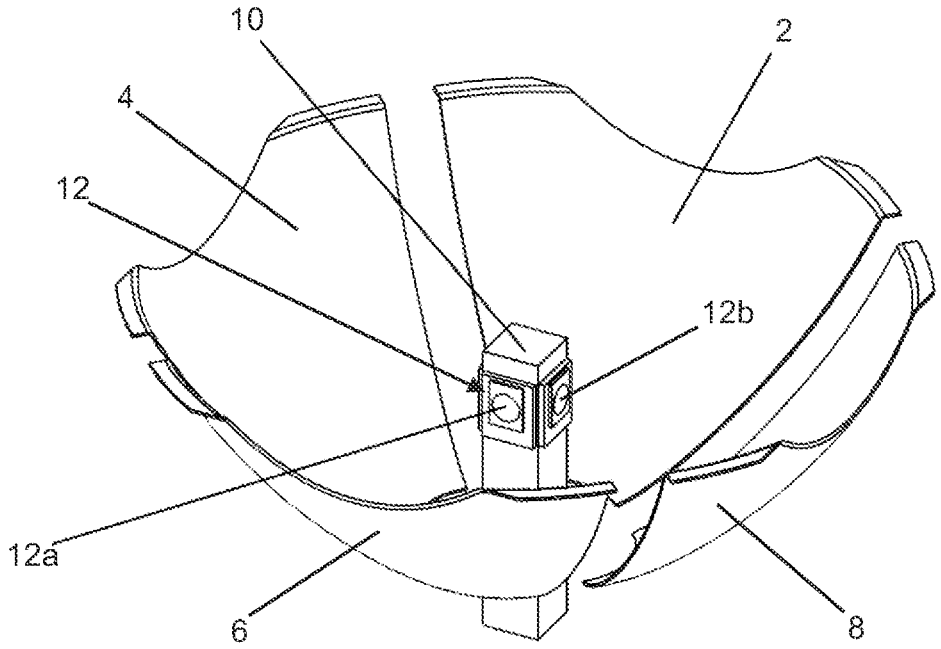
FIG. 1 shows a top, front, and right perspective view of a plurality of reflector segments, a heat exchanger, and a light emitting diode array configured in accordance with at least one embodiment of the present invention in a first state.

FIG. 1 shows a top, front, and right perspective view of a plurality of reflector segments, including reflector segments 2, 4, 6, and 8, a heat exchanger 10, and a light emitting diode array 12 configured in accordance with at least one embodiment of the present invention in a first state. The light emitting diode array 12 includes light emitting diodes 12*a*, 12*b*, and 12*c*, shown in FIG. 2A, and light emitting diode 12*d* shown in FIG. 3.

Figure 2A:
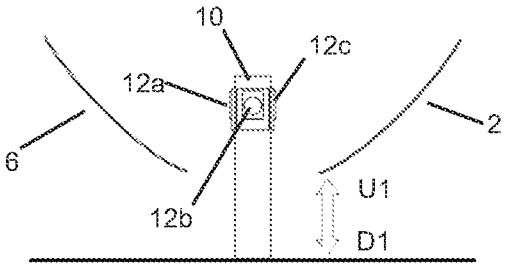
FIG. 2A shows a simplified side view of a first and second segments of the plurality of reflector segments, the heat exchanger, and the light emitting diode array of FIG. 1, with the first and second reflector segments arranged in a first position with respect to each other.

FIG. 2A shows a simplified side view of a first segment 6 and a second segment 2 of the plurality of reflector segments 2, 4, 6, and 8, the heat exchanger 10, and the light emitting diode array 12 of FIG. 1, with the first and second reflector segments 6 and 2 arranged in a first position with respect to each other.

Figure 2B:
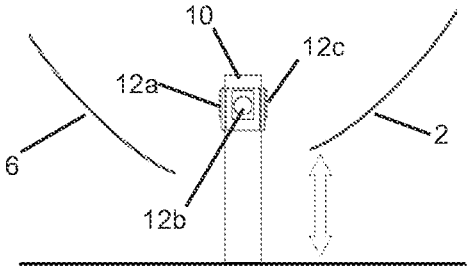
FIG. 2B shows a simplified side view of the first and second segments of the plurality of reflector segments, the heat exchanger, and the light emitting diode array of FIG. 1, with the first and second reflector segments arranged in a second position with respect to each other, after one of the first and second segments has been moved with respect to the other segment.

FIG. 2B shows a simplified side view of the first segment 6 and the second segment 2 of the plurality of reflector segments 2, 4, 6, and 8, the heat exchanger 10, and the light emitting diode array 12 of FIG. 1, with the first and second reflector segments, 6 and 2, respectively arranged in a second position with respect to each other, after the second reflector segment 2 has been moved upward with respect to the first reflector segment 6. In at least one embodiment, reflector segments 2, 4, 6, and 8 are configured so that each of the reflector segments 2, 4, 6, and 8 can be moved in the upwards U1 direction or in the downwards D1 direction, shown in FIG. 2A, with respect to any of the other reflector segments 2, 4, 6, and 8.

Figure 2C:
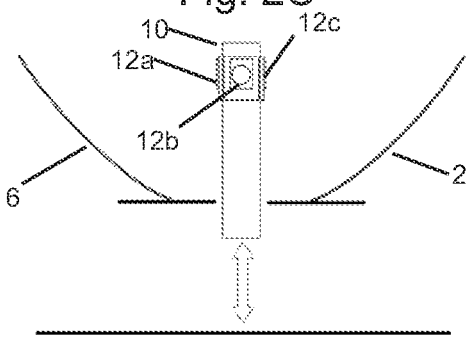
FIG. 2C shows a simplified side view of the first and second segments of the plurality of reflector segments, the heat exchanger, and the light emitting diode array of FIG. 1, with heat exchanger and the light emitting diode array moved upwards with respect to the first and second segments from the position of FIG. 2A.

FIG. 2C shows a simplified side view of the first segment 6 and the second segment 2 of the plurality of reflector segments 2, 4, 6, and 8, the heat exchanger 10, and the light emitting diode array 12 of FIG. 1, with heat exchanger 10 and the light emitting diode array 12 moved upwards, in the direction U1, with respect to the first segment 6 and the second segment 2 from the position of FIG. 2A.

Figure 2D:
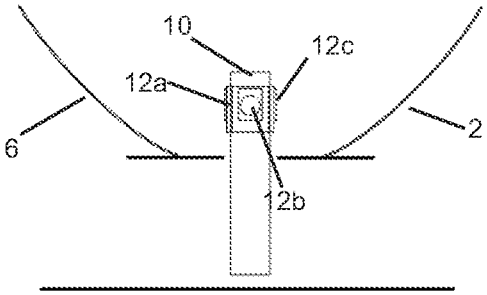
FIG. 2D shows a simplified side view of the first and second segments of the plurality of reflector segments, the heat exchanger, and the light emitting diode array of FIG. 1, with heat exchanger and the light emitting diode array moved downwards with respect to the first and second segments from the position of FIG. 2A.

FIG. 2D shows a simplified side view of the first segment 6 and the second segment 2 of the plurality of reflector segments 2, 4, 6, and 8, the heat exchanger 10, and the light emitting diode array 12 of FIG. 1, with heat exchanger 10 and the light emitting diode array 12 moved downwards with respect to the first segment 6 and the second segment 2 from the position of FIG. 2A.

Figure 3:
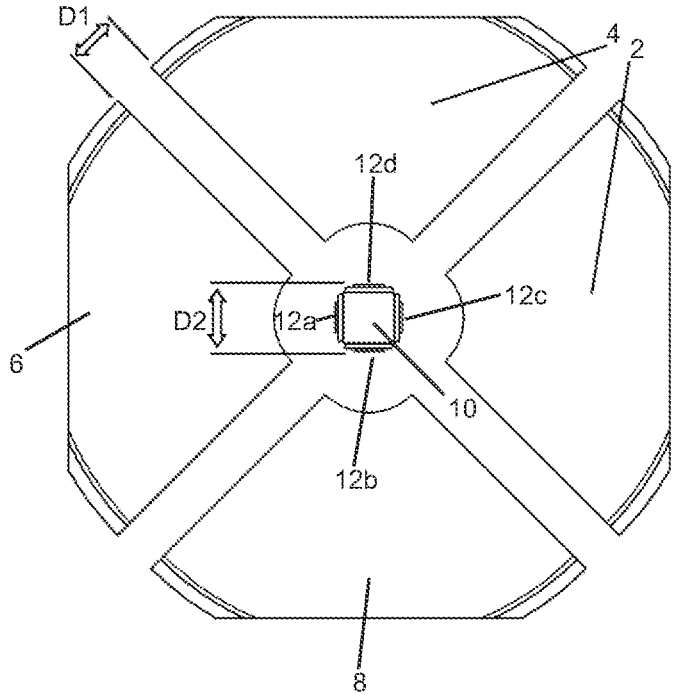
FIG. 3 shows a simplified top view of the plurality of reflector segments, the heat exchanger, and the light emitting diode array, in the first state of FIG. 1.

FIG. 3 shows a simplified top view of the plurality of reflector segments 2, 4, 6, and 8, the heat exchanger 10, and the light emitting diode array 12, in the first state of FIG. 1.

Figure 4A:
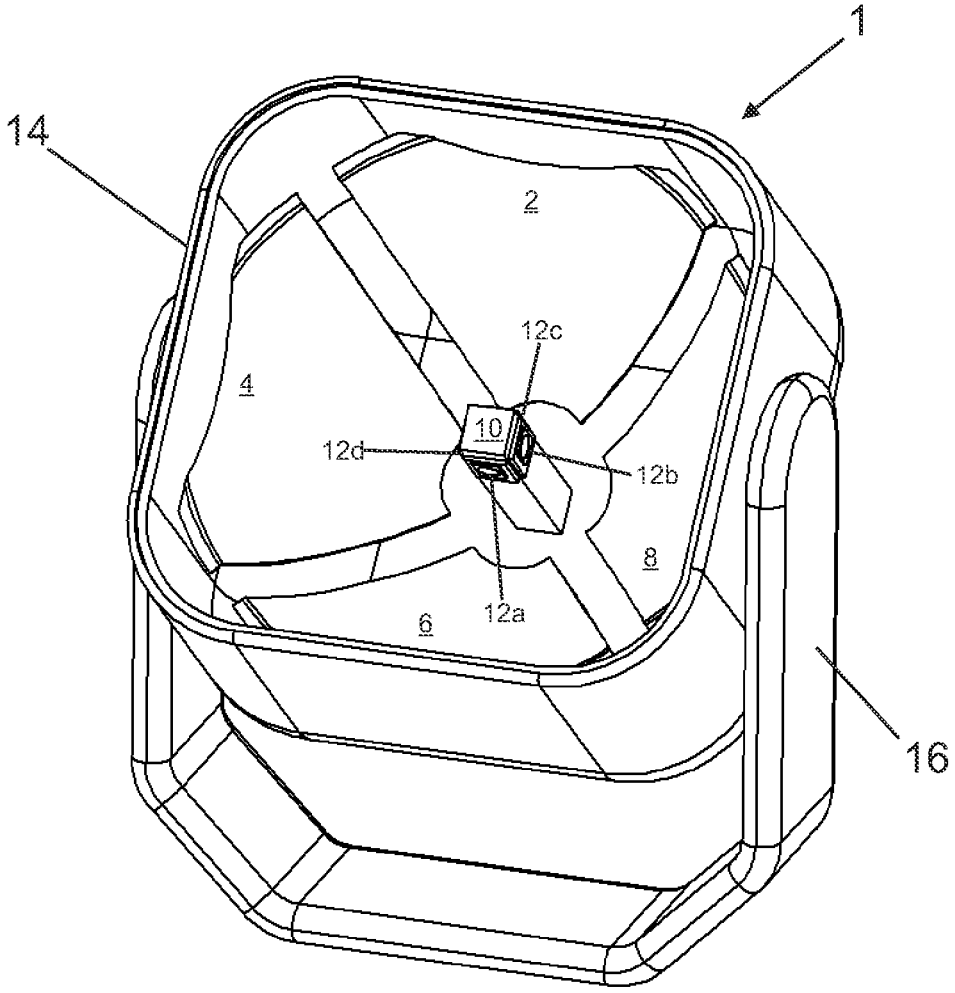
FIG. 4A shows a simplified diagram of the plurality of reflector segments, the heat exchanger, and the light emitting diode array, in the first state of FIG. 1, incorporated in a first multi parameter lighting fixture which includes a lamp housing, and a yoke.

FIG. 4A shows a simplified diagram of the plurality of reflector segments 2, 4, 6, and 8, the heat exchanger 10, and the light emitting diode array 12, in the first state of FIG. 1, incorporated in a first multi parameter lighting fixture 1 which includes a lamp housing 14, and a yoke 16.

Figure 4B:
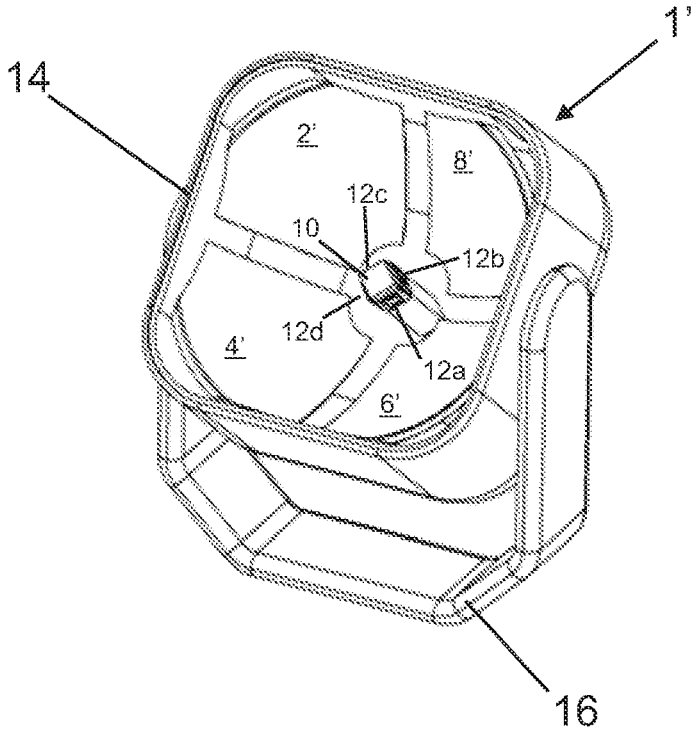
FIG. 4B shows a simplified diagram of a second plurality of reflector segments, the heat exchanger, and the light emitting diode array, incorporated in a second multi parameter lighting fixture which includes the lamp housing and the yoke.

FIG. 4B shows a simplified diagram of a second plurality of reflector segments 2', 4', 6', and 8', the heat exchanger 10, and the light emitting diode array 12, incorporated in a second multi parameter lighting fixture 1' which includes the lamp housing 14 and the yoke 16.

Figure 4C:
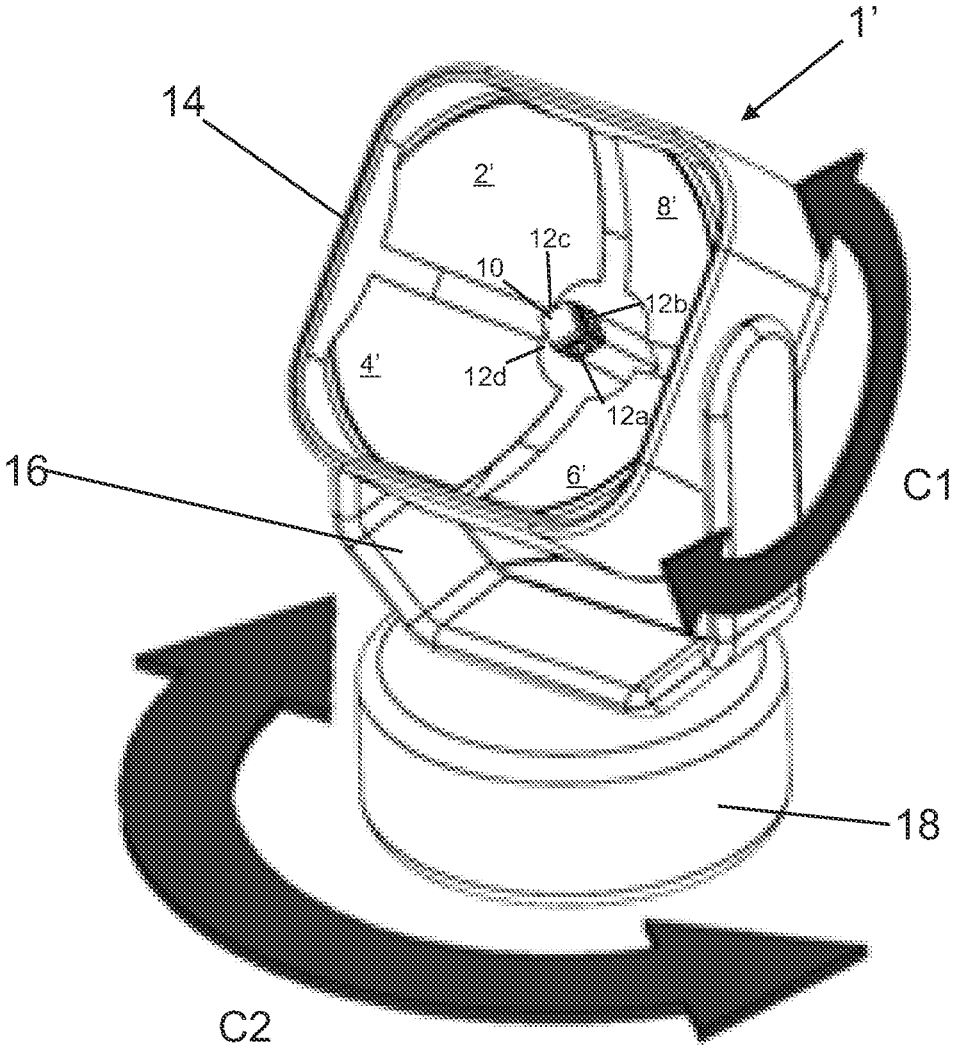
FIG. 4C shows a simplified diagram of the second plurality of reflector segments, the heat exchanger, and the light emitting diode array, incorporated in a second multi parameter lighting fixture which includes the lamp housing and the yoke of FIG. 4B, and in addition with the yoke shown rotatably mounted to a base, and with arrows to show the second multi parameter light fixture's capability of panning and tilting.

FIG. 4C shows a simplified diagram of the second plurality of reflector segment 2', 4', 6', and 8's, the heat exchanger 10, and the light emitting diode array 12, incorporated in a second multi parameter lighting fixture 1' which includes the lamp housing 14 and the yoke 16 of FIG. 4B, and in addition with the yoke 16 shown rotatably mounted to a base 18, and with arrows to show the second multi parameter light fixture's 1' capability of panning and tilting.

Figure 5:
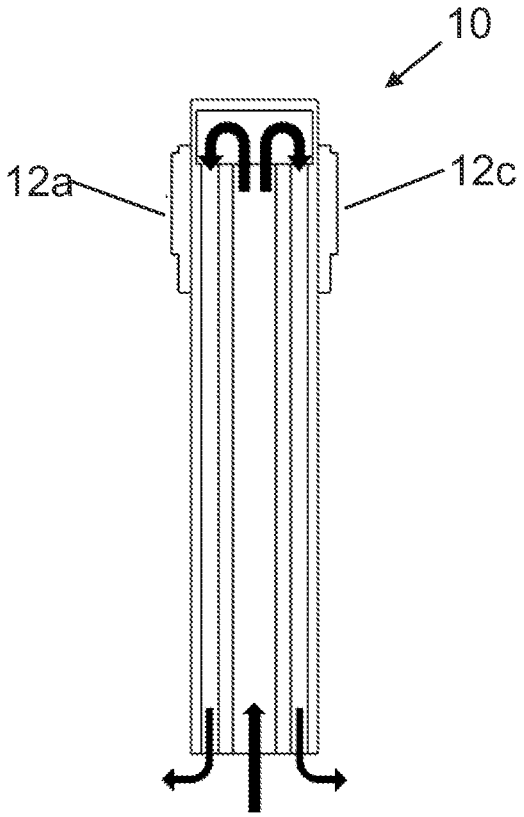
FIG. 5 shows coolant flow in the heat exchanger of FIG. 1.

FIG. 5 shows coolant flow in the heat exchanger 10 of FIG. 1. The flow of the coolant through the heat exchanger 10 is single ended and coaxial (center out).

The heat-exchanger 10 is located in the center of the combination of the reflector segments 2, 4, 6, and 8 or in the center of reflector segments 2', 4', 6', and 8', and can move in and out of the focal point providing a zoom effect transitioning from converging rays to collimated rays to diverging rays. This effect can be either collective by moving the heat-exchanger 10 as shown by the movement from FIG. 2A positioning to FIG. 2C or 2D positioning of the heat-exchange 10, or independent by moving each segment of segments 2, 4, 6, and 8 or 2', 4', 6', and 8' of the overall reflector separately, such as shown by movement from FIG. 2A positioning to FIG. 2B positioning.

Each of the light sources or light emitting diodes 12*a*, 12*b*, 12*c*, and 12*d* is configured to be controlled by a computer processor. This allows for animated effects such as simulated rotation and random shadows. The corresponding light source and reflector segment, such as for example light source 12*c* projects its light rays, primarily or entirely, onto corresponding reflector segment 2, can be used to create complex color combinations and variable beam angles. Similarly, or identically, light source 12*b* projects its light rays, primarily or entirely, onto corresponding reflector segment 8; light source 12*a* projects its light rays, primarily or entirely, onto corresponding reflector segment 6; and light source 12*d* projects its light rays, primarily or entirely, onto corresponding reflector segment 4

The control system, including a computer processor, may be a control system from any one of U.S. Pat. Nos. 10,344,944; 10,718,486; 10,551,034; and 9,404,641, which are incorporated by reference herein. The control system and/or computer processor is configured to be programmed by computer software in accordance with the present invention, to control a motor for moving one or more of the plurality of segments 2, 4, 6, and 8 or one or more of the plurality of segments 2', 4', 6', and 8', and to control lights of light source or light emitting diodes 12*a-d*.

The reflector segments 2, 4, 6, and 8 or 2', 4', 6', and 8' are spaced apart such that the focal point for each of these reflector segments is located at the face of its corresponding light source on one of the four sides of the heat-exchanger 10. Each side of the heat-exchanger 10 will have one segment of the overall reflector. The entire assembly including the overall reflector (including all of segments 2, 4, 6, and 8 or all of segments 2', 4', 6', and 8') and heat-exchanger 10 will be mounted in a motorized yoke 16, which is mounted to a base 18, allowing the pan and tilt of the fixture 1 or 1'.

Two different layouts of two different overall reflectors in the lamp housing 14 are provided by fixture 1 or 1'. Although a square head is shown for the lamp housing 14, other shapes such as a circular arrangement can be employed in alternative embodiments.

In FIGS. 2A-D the method of translation of one or more of the plurality of reflector segments 2, 4, 6, and 8 with respect to other segments of 2, 4, 6, and 8 or segments 2', 4', 6', and 8' with respect to segments 2', 4', 6', and 8' may be executed by a motive force from a stepper motor, servo motor, voice coil, or linear actuator.

Figure 6A:
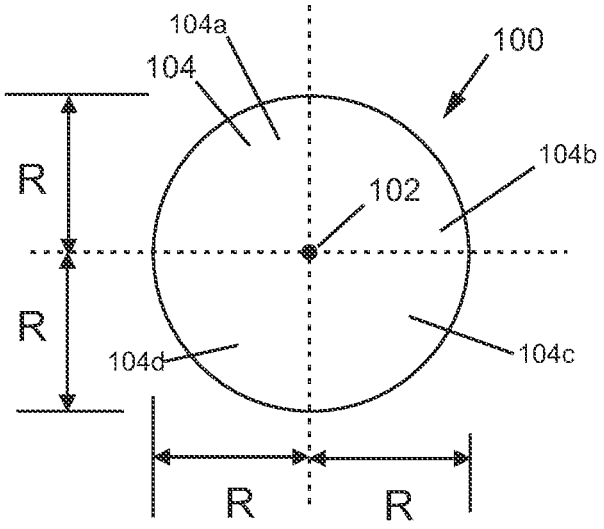
Fig. 6A (Prior Art)
FIG. 6A is a prior art simplified diagram of a point light source at the center of a parabolic light reflector viewed from the front of the parabolic light reflector.
Figure 6B:
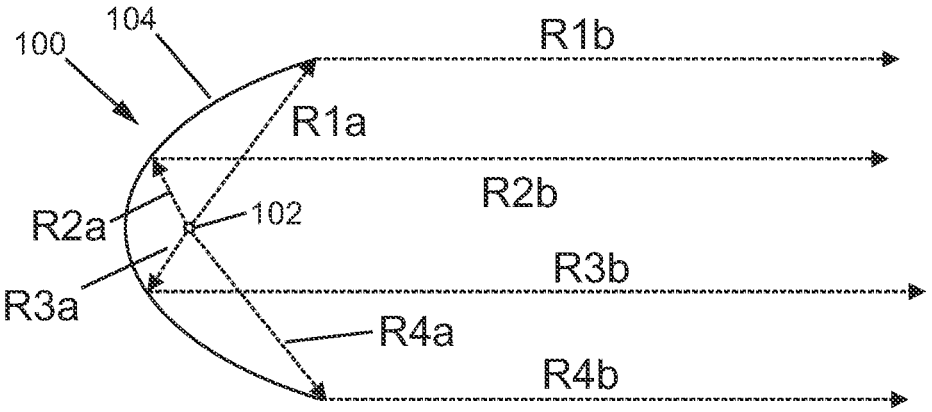
Fig. 6B (Prior Art)
FIG. 6B is a prior art simplified cross section diagram of the point light source and the parabolic reflector of FIG. 6A, with the cross section viewed from the side.

FIG. 6A is a prior art simplified diagram 100 of a point light source 102 at the center of a parabolic light reflector 104 viewed from the front of the parabolic light reflector 104. FIG. 6B is a prior art simplified cross section diagram of the point light source 102 and the parabolic reflector 104 of FIG. 6A, with the cross section viewed from the side In reality, no light source is a point light source, and FIG. 6A and FIG. 6B is a presented as an example in theory of what would happen if a light source were a point light source.

For a theoretical point light source 102, light rays, such as light rays R1*a*, R2*a*, R3*a*, and R4*a*, emanate from point light source 102 and reflect off of parabolic light reflector 104 to form light rays R1*b*, R2*b*, R3*b*, and R4*b*, respectively, as shown in FIG. 6B. The point light source 102 is located at the focal point of the parabolic light reflector 104, which causes light rays R1*b*, R2*b*, R3*b*, and R4*b* (and all other light rays emanating from the parabolic light reflector 104 due to point light source 102) to be parallel to each other. The light rays R1*b*, R2*b*, R3*b*, and R4*b* are thus said to be collimated.

Figure 7A:
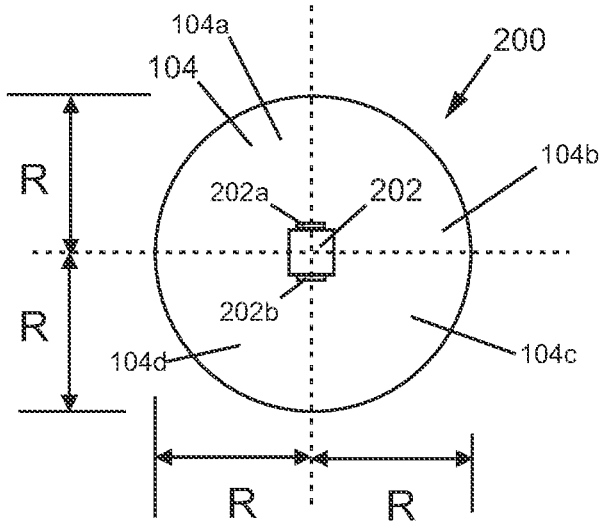
Fig. 7A (Prior Art)
FIG. 7A is a prior art simplified diagram of two light sources on a square housing, where the square housing is substantially at the center of the parabolic light reflector, viewed from the front of the parabolic light reflector.
Figure 7B:
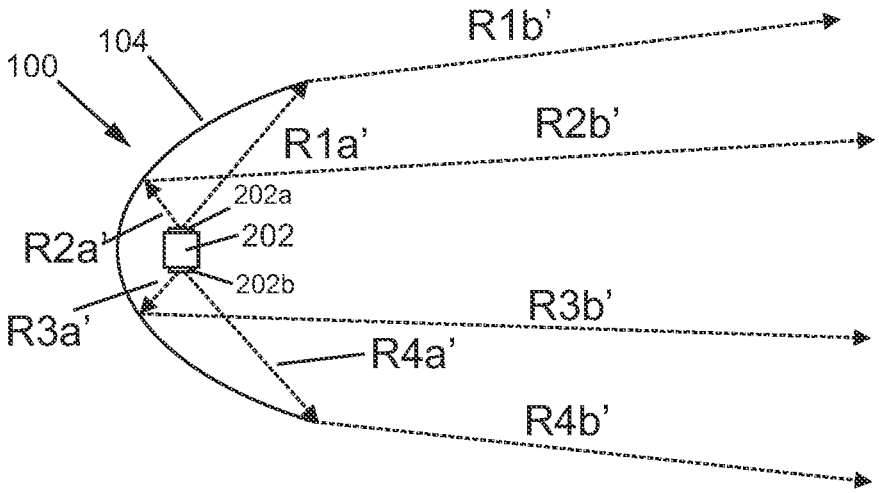
Fig. 7B (Prior Art)
FIG. 7B is a prior art simplified cross section diagram of the two light sources on the square housing and the parabolic reflector of FIG. 7A, with the cross section viewed from the side.

However, if one uses two flat light sources 202*a* and 202*b*, spaced apart and attached to a housing 202 as in FIG. 7A one gets a different result for reflected light rays as shown in FIG. 7B.

FIG. 7A is a prior art simplified diagram of two light sources 202*a* and 202*b* on a square housing 202, where the square housing 202 is substantially at the center of the parabolic light reflector 104, viewed from the front of the parabolic light reflector 104. FIG. 7B is a prior art simplified cross section diagram of the two light sources 202*a* and 202*b* on the square housing 202 and the parabolic reflector 104 of FIG. 7A, with the cross section viewed from the side.

For the light sources 202*a* and 202*b*, with the square housing 202 substantially at the focal point of the parabolic reflector 104, light rays, such as light rays from light source 202*a*, such as light rays R1*a*' and R2*a*' emanate from and reflect off of parabolic light reflector 104 to form light rays R1*b*' and R2*b*', respectively; and light rays from light source 202*b*, such as light rays R3*a*' and R4*a*' emanate from and reflect off of parabolic light reflector 104 to form light rays R3*b*' and R4*b*', respectively.

Because the light sources 202*a* and 202*b* are not point light sources, the reflected light rays R1*b*', R2*b*', R3*b*', and R4*b*' are not parallel to each other, i.e. are not collimated.

Figure 8A:
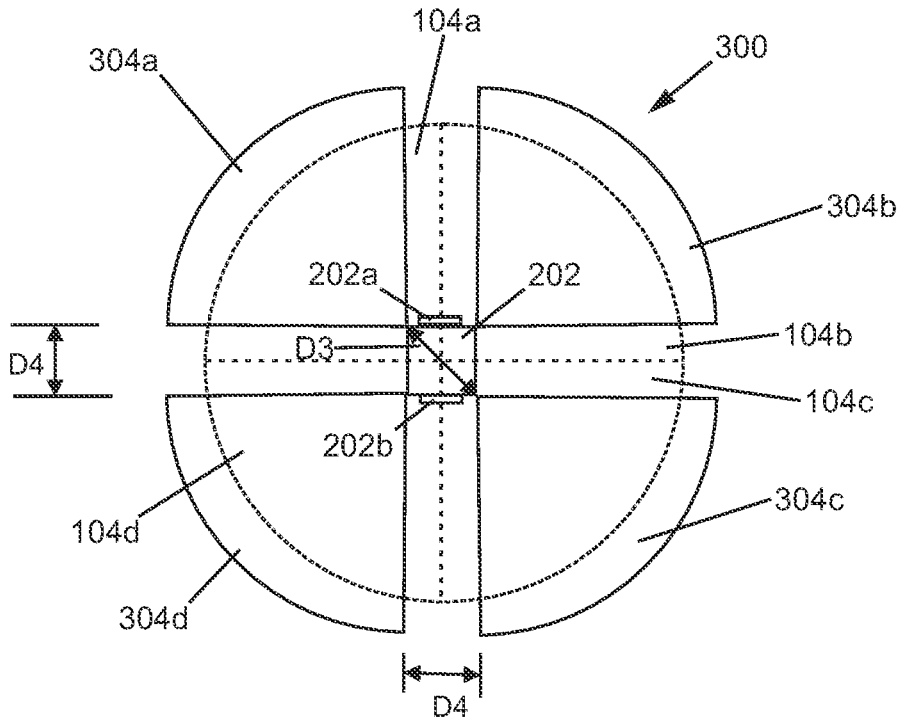
FIG. 8A is a simplified diagram of two light sources on a square housing, where the square housing is substantially at the center of four parabolic light reflector segments in accordance with an embodiment of the present invention, viewed from the front of the four parabolic light reflector segments.

FIG. 8A is a simplified diagram of two light sources 202*a* and 202*b* on a square housing 202, where the square housing 202 is substantially at the center of four parabolic light reflector segments 304*a*, 304*b*, 304*c*, and 304*d* in accordance with an embodiment of the present invention, viewed from the front of the four parabolic light reflector segments 304*a-d*.

Figure 8B:
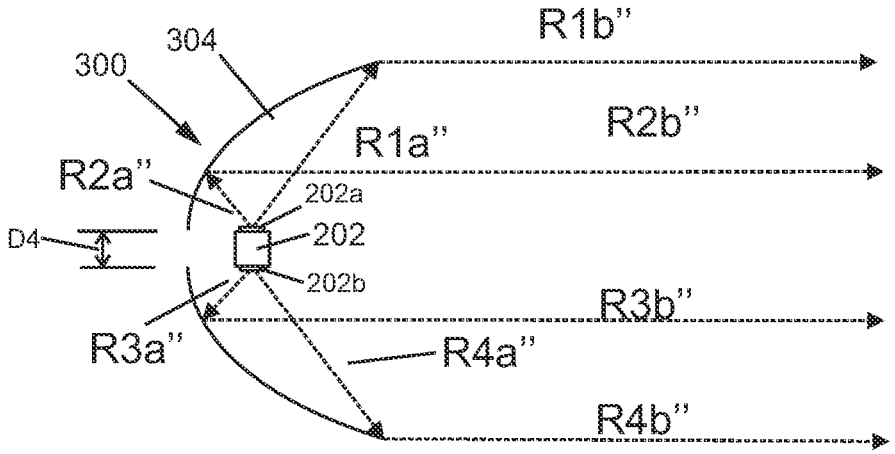
FIG. 8B is a simplified cross section diagram of the two light sources on the square housing and the parabolic light reflector segments of FIG. 8A, with the cross section viewed from the side.

FIG. 8B is a simplified cross section diagram of the two light sources 202*a* and 202*b* on the square housing 202 and the parabolic light reflector segments 304*a-d* of FIG. 8A, with the cross section viewed from the side.

One can form the segments 304*a-d* and position the segments 304*a-d* by cutting the parabolic reflector 104 into quadrant segments 104*a*, 104*b*, 104*c*, and 104*d* (shown by dashed lines in FIG. 8A), respectively, and moving each quadrant segment 104*a-d* outwards a distance one half the diagonal distance D3 along the line of the diagonal having dimension D3 shown in FIG. 8A. Each of the segments 304*a-d*, after being moved one half the diagonal distance D3, along the line of the diagonal having dimension D3, is now a horizontal distance and a vertical distance of D4 away from adjacent segments. For example, segment 304*a* is at a vertical distance of D4 away from segment 304*d* and at a horizontal distance of D4 away from segment 304*b*.

Positioning the segments 304*a-d*, for example by cutting the reflector 104 into segments 104*a-d* and moving those segments outwards to form and position segments 304-*d* as shown in FIG. 8A results in collimated or parallel light rays R1*b*", R2*b*", R3*b*", and R4*b*", due to light rays R1*a*" (from light source 202*a*), R2*a*" (from light source 202*a*), R3*a*" (from light source 202*b*), and R4*a*" (from light source 202*b*).

Note that instead of cutting an integrated reflector 104 to form segments 304*a-d*, in accordance with another embodiment of the present invention, a reflector segment 304*a* can first be formed, for example, and then each of reflector segments 304*b-d* can be formed as duplicates of the segment 304*a*, and then segments 304*a-d* are configured to be appropriately rotated, oriented, and/or positioned as in FIG. 8A.

Figure 9A:
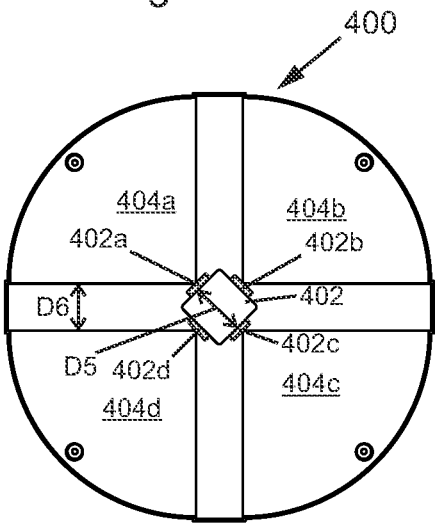
FIG. 9A is a simplified diagram of a square housing (having four light sources, not shown, one directed at each of four reflector segments), where the square housing is substantially at the center of four parabolic light reflector segments in accordance with an embodiment of the present invention, viewed from the front of the four parabolic light reflector segments.
Figure 9B:
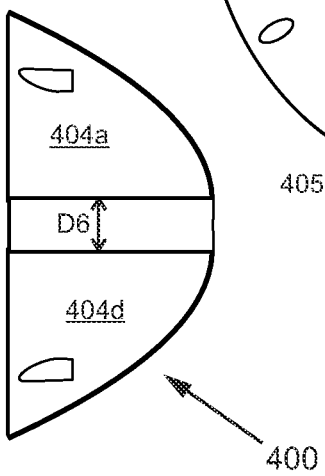
FIG. 9B is a simplified sectional diagram of two of the four parabolic light reflector segments of FIG. 9A viewed from the side.
Figure 9C:
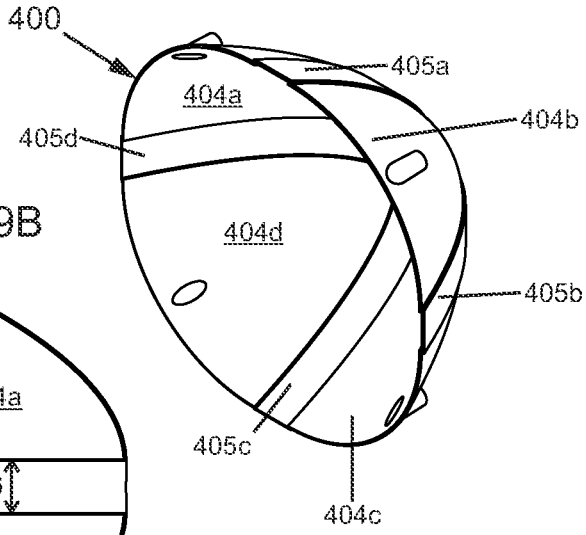
FIG. 9C is a simplified perspective view of the four parabolic light reflector segments of FIG. 9A.

FIG. 9A is a simplified diagram of an apparatus 400 including a square housing 402 (having four light sources, not shown, one directed at each of four reflector segments 404*a-d*), where the square housing 402 is substantially at the center of four parabolic light reflector segments 404*a-d*, and substantially at the focal point of the segments 402-*d*, in accordance with an embodiment of the present invention, viewed from the front of the four parabolic light reflector segments 404*a-d*. FIG. 9B is a simplified sectional diagram of the apparatus 400, with two of the four parabolic light reflector segments 404*a-d* of FIG. 9A viewed from the side; and FIG. 9C is a simplified perspective view of the apparatus 400, including the four parabolic light reflector segments 404*a-d*.

In FIG. 9A, the housing 402 is at an angle which is forty-five degrees different than from the housing 202 FIG. 8A. The segments 404*a-d* may have been positioned by moving them half the distance D5 away from the housing 402 along the line of dimension D5. Each of segments 404*a-d*, ends up at a position shown in FIG. 9A, which is a vertical distance of D6 and a horizontal distance of D6 away from adjacent segments of segments 404*a-d*.

In at least one embodiment, the segment 404*a* is connected to the segment 404*b* by member 405*a* which, in at least one embodiment, may be made of any suitable spacing material such as including polymers such as polymethyl methacrylate (PMMA), polycarbonate, or a metal substrate. Similarly, the segment 404*b* is connected to the segment 404*c* by member 405*b* which may be made of a similar or identical material as segment 404*a*. Similarly, the segment 404*c* may be connected to the segment 404*d* by member 405*c* which may be made of a similar or identical material as segment 404*a*. Similarly, the segment 404*d* may be connected to the segment 404*a* by a member 405*d* which may be made of a similar or identical material as segment 404*a*.

The combination of reflector segments 404*a-d* in the diagram 400 of FIG. 9A, may be called an integrated reflector.

The apparatus 400 shown in FIGS. 9A-9C may be injection molded of a polymer such as Poly(methyl methacrylate) or PMMA, polycarbonate.

Although a square or rectangular housing 402 is shown for the heat exchanger of the apparatus 400 and a square and/or rectangular housing 10 is shown for the heat exchanger of the apparatus of FIG. 1, other geometries such as triangular, rectangular may be implemented with corresponding quantities of reflector segments.

For example a triangular heat exchanger may be provided with three sides which would have three corresponding reflector segments in at least one embodiment.

In at least one embodiment, each of a plurality of reflector segments, such as segments 2, 4, 6, and 8 shown in FIG. 3; segments 304*a-d* shown in FIG. 8A; or segments 404*a-d* shown in FIGS. 9A-C; are spaced apart, from the rest of the plurality of segments in a horizontal direction which is substantially perpendicular to a direction of a beam of reflected light due to light from a plurality of light sources reflecting off of the plurality of reflector segments.

For example, reflector segment 2 is spaced apart a horizontal distance of D1 from adjacent reflector segments 4 and 8, and is spaced apart a horizontal distance from reflector segment 6, wherein the direction of the spacing of the horizontal distance, such as D1, is perpendicular or substantially perpendicular to the direction of a beam of reflected light, from reflector segments 2, 4, 6, and 8, due to light from plurality of light sources 12-*d*, as shown in FIG. 3.

Similarly, or identically, reflector segment 4 is spaced apart a horizontal distance of D1 from adjacent reflector segments 2 and 6, and is spaced apart a horizontal distance from reflector segment 8, wherein the direction of the spacing of the horizontal distance, such as D1, is perpendicular or substantially perpendicular to the direction of a beam of reflected light, from reflector segments 2, 4, 6, and 8, due to light from plurality of light sources 12-*d*, as shown in FIG. 3.

Similarly, or identically, reflector segment 6 is spaced apart a horizontal distance of D1 from adjacent reflector segments 4 and 8, and is spaced apart a horizontal distance from reflector segment 2, wherein the direction of the spacing of the horizontal distance, such as D1, is perpendicular or substantially perpendicular to the direction of a beam of reflected light, from reflector segments 2, 4, 6, and 8, due to light from plurality of light sources 12-*d*, as shown in FIG. 3.

Similarly, or identically, reflector segment 8 is spaced apart a horizontal distance of D1 from adjacent reflector segments 2 and 6, and is spaced apart a horizontal distance from reflector segment 4, wherein the direction of the spacing of the horizontal distance, such as D1, is perpendicular or substantially perpendicular to the direction of a beam of reflected light, from reflector segments 2, 4, 6, and 8, due to light from plurality of light sources 12-*d*, as shown in FIG. 3.

The light sources 12*a-d* are located substantially at the focal points of the first reflector segments 6, 8, 2, and 4, respectively.

The configuration of FIG. 3, in at least one embodiment, optimizes collimation of light rays from the reflector segments 2, 4, 6, and 8 similar to as shown by FIG. 8B.

Similarly or identically, as shown in FIG. 9A, reflector segment 404*a* is spaced apart a horizontal distance of D6 from adjacent reflector segments 404*b* and 404*d*, and is spaced apart a horizontal distance from reflector segment 404*c*, wherein the direction of the spacing of the horizontal distance, such as D6, is perpendicular or substantially perpendicular to the direction of a beam of reflected light, from reflector segments 404*a-d*, due to light from a plurality of light sources 402*a-b*, as shown in FIG. 9A.

Similarly or identically, as shown in FIG. 9A, reflector segment 404*b* is spaced apart a horizontal distance of D6 from adjacent reflector segments 404*a* and 404*c*, and is spaced apart a horizontal distance from reflector segment 404*d*, wherein the direction of the spacing of the horizontal distance, such as D6, is perpendicular or substantially perpendicular to the direction of a beam of reflected light, from reflector segments 404*a-d*, due to light from a plurality of light sources 402*a-b*, as shown in FIG. 9A.

Similarly or identically, as shown in FIG. 9A, reflector segment 404*c* is spaced apart a horizontal distance of D6 from adjacent reflector segments 404*b* and 404*d*, and is spaced apart a horizontal distance from reflector segment 404*a*, wherein the direction of the spacing of the horizontal distance, such as D6, is perpendicular or substantially perpendicular to the direction of a beam of reflected light, from reflector segments 404*a-d*, due to light from a plurality of light sources 402*a-b*, as shown in FIG. 9A.

Similarly or identically, as shown in FIG. 9A, reflector segment 404*d* is spaced apart a horizontal distance of D6 from adjacent reflector segments 404*a* and 404*c*, and is spaced apart a horizontal distance from reflector segment 404*c*, wherein the direction of the spacing of the horizontal distance, such as D6, is perpendicular or substantially perpendicular to the direction of a beam of reflected light, from reflector segments 404*a-d*, due to light from a plurality of light sources 402*a-b*, as shown in FIG. 9A.

In at least one embodiment, each of the reflector segments are spaced apart from one or more adjacent reflector segments of the plurality of reflector segments by a distance of at least a dimension of a housing to which the plurality of light sources are fixed. For example, reflector segment 404*a* is spaced apart by D6 from adjacent segments 404*b* and 404*d*, and the spacing D6 may be equal to or greater than the width, D5, of a housing 402 wherein the housing 402 may be part of or the same as a heat exchanger 402. Similarly, or identically, In the embodiment of FIG. 3, the reflector segment 4 is spaced apart by D1 from adjacent segments 6 and 2, and the spacing D1 may be equal to or greater than the width, D2, of a housing or heat exchanger 10 or the combination of housing 10 and light sources 12*a-d*.

In at least one embodiment, a plurality of reflector segments are movable in a vertical direction with respect to each other, wherein the vertical direction is perpendicular to the horizontal direction. For example, the segments 2, 4, 6, and 8 may be configured to be movable in a vertical direction U1 or a vertical direction D1 as shown by FIGS. 2A-2D.

Similarly or identically, each of the segments 404*a-d* may be configured to be movable in a vertical direction, with respect to each other, and with respect to housing or heat exchanger 402, which is perpendicular to a horizontal direction, where the horizontal direction is perpendicular to the direction of a beam from reflected light from the segments 404*a-d*, due to light from light sources 402*a*-402*d*.

In at least one embodiment, each of the plurality of light sources, such as light sources 402*a*-402*d*, is mounted to a housing, such as housing or heat exchanger 402 which is at a center formed by the plurality of reflector segments 404*a-d*, such that there is a horizontal gap between the housing 402 and any reflector. This configuration in at least one embodiment, helps to optimize collimation of light rays, such as shown for example, in FIG. 8B.

In at least one embodiment, each of the plurality of reflector segments, such as 404*a-d* shown in FIG. 9A, is substantially the same as each of the other reflector segments of the plurality of reflector segments 404*a-d*. The similar construction, in at least one embodiment, helps to optimize collimation of light rays, such as shown for example in FIG. 8A.

In at least one embodiment, the housing, such as housing 402 is configured so that the housing 402 does not overlap any reflector in the horizontal direction. This may also be done to help optimize collimation of light rays, such as shown for example in FIG. 8A.

In FIGS. 9A-9C or FIG. 8A-8B, the segments 404*a-d* or 304*a-d* may be translated or moved physically with respect to each other, or with respect to the housing or heat exchanger 202 or 402, respectively. The method of translation of one or more of the plurality of reflector segments 404*a-d* or 304*a-d*, with respect to other segments of 404*a-d* or 304*a-d*, respectively, or with respect to appropriate heat exchanger 202 or 402, may be executed by a motive force from a stepper motor, servo motor, voice coil, or linear actuator, which may be physically connected to the respective reflector segment, wherein a reflector segment may be described as including a stepper motor, servo motor, voice coil, or linear actuator.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. A theatrical lighting apparatus comprising a plurality of light sources including a first light source and a second light source; and a plurality of reflector segments including a first reflector segment and a second reflector segment, wherein each of the plurality of reflector segments are spaced apart from the rest of the plurality of reflector segments in a horizontal direction which is substantially perpendicular to a direction of a beam of reflected light due to light from the plurality of light sources reflecting off of the plurality of reflector segments;

wherein the first light source is located substantially at the focal point of the first reflector segment;

wherein the second light source is located substantially at the focal point of the second reflector segment; and wherein the focal point of the first reflector segment differs from the focal point of the second reflector segment; and wherein each of the plurality of reflector segments are spaced apart from one or more adjacent reflector segments of the plurality of reflector segments by a distance of at least a dimension of a housing to which the plurality of light sources are fixed.

2. The theatrical lighting apparatus of claim 1 wherein each of the plurality of reflector segments are movable in a vertical direction with respect to each other, wherein the vertical direction is perpendicular to the horizontal direction, such that when a reflector segment of the plurality of reflector segments is moved in the vertical direction out of alignment with respect to an adjacent reflector segment of the plurality of reflector segments, a vertical gap is created between the reflector segment that has been moved in the vertical direction and the adjacent reflector segment of the plurality of reflector segments;

and wherein the reflector segment that has been moved in the vertical direction and the adjacent reflector segment are detached from one another.

3. The theatrical lighting apparatus of claim 1 wherein each of the plurality of reflector segments are movable in a vertical direction with respect to the first light source and the second light source, wherein the vertical direction is perpendicular to the horizontal direction, such that when a reflector segment of the plurality of reflector segments is moved in the vertical direction out of alignment with respect to an adjacent reflector segment of the plurality of reflector segments, a vertical gap is created between the reflector segment that has been moved in the vertical direction and the adjacent reflector segment of the plurality of reflector segments;

and wherein the reflector segment that has been moved in the vertical direction and the adjacent reflector segment are detached from one another.

4. The theatrical lighting apparatus of claim 1 wherein each of the plurality of light sources is mounted to a housing which is at a center formed by the plurality of reflector segments, such that there is a horizontal gap between the housing and any reflector.

5. The theatrical lighting apparatus of claim 1 wherein each of the plurality of reflector segments is substantially the same as each of the other reflector segments of the plurality of reflector segments.

6. The theatrical lighting apparatus of claim 4 wherein the housing is configured so that the housing does not overlap any reflector in the horizontal direction.

7. The theatrical lighting apparatus of claim 1 wherein the plurality of light sources is comprised of at least one white light emitting diode light source.

8. The theatrical lighting apparatus of claim 1 wherein the plurality of light sources are fixed to a single heat exchanger centrally located between the plurality of reflector segments.

9. The theatrical lighting apparatus of claim 8 wherein the heat exchanger has a square geometry.

10. The theatrical lighting apparatus of claim 8 wherein the heat exchanger is configured to be moved relative to the plurality of reflector segments by an actuator.

11. The theatrical lighting apparatus of claim 8 wherein the heat exchanger is comprised of a liquid cooling system.

12. The theatrical lighting apparatus of claim 1 wherein the plurality of reflector segments includes one or more further reflector segments in addition to the first reflector segment and the second reflector segment; and at least two adjacent reflector segments of the plurality of reflector segments are individually moveable by an actuator in relation to the other reflector segments of the plurality of reflector segments by an actuator to cause a vertical gap between the at least two adjacent reflector segments of the plurality of reflector segments to increase, wherein the vertical gap is perpendicular to the horizontal direction; and wherein the at least two adjacent reflector segments are detached from one another.

13. The theatrical lighting apparatus of claim 1 further comprising a positioning system to direct the light emitted from the plurality of light sources directed by the plurality of reflector segments.

14. The theatrical lighting apparatus of claim 1 further comprising a lamp housing;

a yoke; and a base;

wherein the lamp housing, the yoke, and the base are configured with respect to each other to permit panning and tilting of the theatrical lighting apparatus; and wherein the plurality of light sources, and the plurality of reflector segments are located in the lamp housing.

15. The apparatus of claim 1 wherein the plurality of reflector segments are shaped so that when combined they form a parabolic light reflector.

16. A method comprising:

providing a plurality of light sources including a first light source and a second light source; and providing a plurality of reflector segments including a first reflector segment and a second reflector segment;

wherein the plurality of light sources are centrally located between the plurality of reflector segments;

wherein each of the plurality of reflector segments has a focal point;

wherein the first light source is located approximately at the focal point of the first reflector segment;

wherein the second light source is located approximately at the focal point of the second reflector segment;

wherein each of the plurality of reflector segments are spaced apart from the rest of the plurality of reflector segments in a horizontal direction which is substantially perpendicular to a direction of a beam of reflected light due to light from the plurality of light sources reflecting off of the plurality of reflector segments; and wherein the focal point of the first reflector segment differs from the focal point of the second reflector segment; and wherein each of the plurality of reflector segments are spaced apart from one or more adjacent reflector segments of the plurality of reflector segments by a distance of at least a dimension of a housing to which the plurality of light sources are fixed.

17. The method of claim 16 wherein the plurality of light sources is comprised of at least one white light emitting diode light source.

18. The method of claim 16 wherein the plurality of light sources are fixed to a single heat exchanger centrally located between the plurality of reflector segments.

19. The method of claim 18 wherein the heat exchanger is configured to be moved relative to the plurality of reflector segments by an actuator.

20. The method of claim 18 wherein the heat exchanger is comprised of a liquid cooling system.

21. The method of claim 16 wherein the plurality of reflector segments includes one or more further reflector segments in addition to the first reflector segment and the second reflector segment; and at least two adjacent reflector segments of the plurality of reflector segments are individually moveable by an actuator in relation to the other reflector segments of the plurality of reflector segments by an actuator to cause a vertical gap between the at least two adjacent reflector segments of the plurality of reflector segments to increase, wherein the vertical gap is perpendicular to the horizontal direction; and wherein the at least two adjacent reflector segments are detached from one another.

22. The method of claim 16 further comprising directing the light emitted from the plurality of light sources by use of the plurality of reflector segments through a positioning system.

23. The method of claim 16 wherein each of the plurality of reflector segments are movable in a vertical direction with respect to each other, wherein the vertical direction is perpendicular to the horizontal direction, such that when a reflector segment of the plurality of reflector segments is moved in the vertical direction out of alignment with respect to a different reflector segment of the plurality of reflector segments, a vertical gap is created between the reflector segment that has been moved in the vertical direction and to the different reflector segment of the plurality of reflector segments.

24. The method of claim 16 wherein the plurality of reflector segments are shaped so that when combined they form a parabolic light reflector.

* * * * *